US006389604B1

(12) United States Patent
Day

(10) Patent No.: US 6,389,604 B1
(45) Date of Patent: May 21, 2002

(54) INFLATABLE HEADWEAR

(75) Inventor: Maureen Day, Florissant, MO (US)

(73) Assignee: Betallic, LLC, St. Louis, MO (US)

( * ) Notice: Subject to any disclaimer, the term of this patent is extended or adjusted under 35 U.S.C. 154(b) by 0 days.

(21) Appl. No.: 09/916,014

(22) Filed: Jul. 26, 2001

(51) Int. Cl.[7] ..... A42B 1/00
(52) U.S. Cl. ..... 2/200.1; 2/DIG. 3; 2/DIG. 10
(58) Field of Search ..... 2/200.1, 198, DIG. 3, 2/421, 171, 183, DIG. 10; D2/865, 869, 866

(56) References Cited

U.S. PATENT DOCUMENTS

| | | | | | |
|---|---|---|---|---|---|
| 805,750 | A | * | 11/1905 | Redgrave | 2/DIG. 3 |
| 2,803,015 | A | * | 8/1957 | Milone | 2/DIG. 3 |
| 3,031,681 | A | | 5/1962 | Hoeflich | |
| 3,184,757 | A | | 5/1965 | Pennington | |
| D246,617 | S | | 12/1977 | Tomlin, Jr. | |
| 4,218,780 | A | | 8/1980 | Growe et al. | |
| 4,324,005 | A | | 4/1982 | Willis | |
| D277,996 | S | | 3/1985 | Megargee | |
| D287,891 | S | | 1/1987 | Cavaliere | |
| 4,864,663 | A | | 9/1989 | Horan | |
| 4,917,646 | A | | 4/1990 | Kieves | |
| D326,555 | S | | 6/1992 | Selame et al. | |
| D328,179 | S | * | 7/1992 | Barker | 2/DIG. 3 |
| 5,129,106 | A | | 7/1992 | Liou | |
| D336,543 | S | | 6/1993 | Murray, III et al. | |
| D338,562 | S | | 8/1993 | Barker et al. | |
| 5,243,707 | A | | 9/1993 | Bodinet | |
| 5,259,070 | A | * | 11/1993 | De Roza | 2/DIG. 3 |
| D354,614 | S | | 1/1995 | Chen | |
| D357,569 | S | | 4/1995 | Jacobellis | |
| D387,542 | S | | 12/1997 | Smith | |
| D390,341 | S | | 2/1998 | Levy | |
| D410,318 | S | | 6/1999 | Chen | |
| 6,094,742 | A | * | 8/2000 | Gattamorta | 2/DIG. 3 |
| D440,742 | S | | 4/2001 | Mitchell | |

* cited by examiner

*Primary Examiner*—Danny Worrell
(74) *Attorney, Agent, or Firm*—Thompson Coburn LLP

(57) ABSTRACT

An article of decorative headwear comprises first and second flexible, generally gas-impermeable material. Each of the first and second sheets has a peripheral edge portion. The first and second sheets are sealed to one another at their respective peripheral edge portions to define an inflatable volume between the first and second sheets. The first and second sheets are shaped to define a primary inflatable portion and a pair of inflatable leg portions that extend from the primary inflatable portion. The inflatable leg portions are spaced from one another to define a head-receiving space between them, which is adapted for receiving a wearer's head. The inflatable leg portions are adapted for engagement with side portions of the wearer's head in a manner to retain the headwear on the wearer's head when the inflatable leg portions are inflated.

19 Claims, 2 Drawing Sheets

INFLATABLE HEADWEAR

BACKGROUND OF THE INVENTION

The present invention relates to articles of decorative headwear and methods of wearing the same. More particularly, the present invention relates to articles of inflatable headwear in the nature of costumes and party favors adapted to embrace various themes, including holiday themes.

A variety of party hats and other decorative novelty headwear is provided in the prior art. Typically, such headwear is fabricated from relatively inexpensive materials, e.g., paper, cardboard, metal foil, plastic or rubber, and is formed in shapes intended to embrace a particular theme for amusement, entertainment or advertising purposes. In many cases, such headwear is adapted to be positioned on a wearer's head and held thereto with a chin-strap or the like.

U.S. Pat. Nos. 4,218,780 and 5,243,707 issued to Growe et al. and Bodinet, respectively, disclose examples of inflatable headwear. Specifically, Growe et al. discloses an article of inflatable costume headwear comprising a lower helmet portion with an inflatable rim adapted for fitting the helmet portion on a wearer's head, a separately inflatable upper decorative portion attached to the lower helmet portion, and a chin-strap adapted to hold the lower helmet portion on the wearer's head. Bodinet discloses an inflatable hat constructed from a pair of metallized, gas-impermeable polymeric sheets sealed to one another at their peripheries to form an inflatable volume. The Bodinet hat includes an uninflated crown portion adapted to fit over a wearer's head, and a chin-strap for securing the hat in place on the wearer's head.

While Growe et al. and Bodinet both provide relatively inexpensive means for creating three-dimensional decorative headwear, they do not represent ideal solutions. The costume headwear disclosed in Growe et al. is rather complicated in construction, has at least two separate inflatable sections that must be inflated independently of one another, and is apparently so top-heavy that it requires a chin-strap. The uninflated crown portion of the Bodinet hat is presumably rather flimsy and, consequently, the chin-strap is needed to retain the hat on the wearer's head, especially when the upper portion of the hat is weighted with decorative adornments. Moreover, in parties and other social settings, the form-fitting helmet/crown portions of the Growe et al. and Bodinet hats may be uncomfortably warm for prolonged wear and may undesirably affect the wearer's hair style.

Thus, there is a need for improved decorative novelty headwear that addresses problems of the prior art, without being prohibitively expensive.

SUMMARY OF THE INVENTION

It is an object of the present invention to provide articles of three-dimensional novelty headwear that can be manufactured relatively inexpensively in a variety of shapes and sizes to embrace various themes, such as holiday themes.

A related object of the invention is to provide articles of inflatable headwear fabricated from relatively inexpensive materials, such as latex, Mylar®, or other flexible, generally gas-impermeable materials.

Another object of the invention is to provide articles of decorative inflatable headwear having at least one inflatable volume shaped to fit and be retained on a wearer's head, without the need for a chin strap.

Still another object of the invention is to provide articles of inflatable headwear utilizing technology now employed in the manufacture of Mylar® novelty balloons and also in the manufacture of conventional latex balloons.

In general, in one aspect of the present invention, article of decorative headwear comprises first and second flexible, generally gas-impermeable material. Each of the first and second sheets has a peripheral edge portion. The first and second sheets are sealed to one another at their respective peripheral edge portions to define an inflatable volume between the first and second sheets. The first and second sheets are shaped to define a primary inflatable portion and a pair of inflatable leg portions that extend from the primary inflatable portion. The inflatable leg portions are spaced from one another to define a head-receiving space between them, which is adapted for receiving a wearer's head. The inflatable leg portions are adapted for engagement with side portions of the wearer's head in a manner to retain the headwear on the wearer's head when the inflatable leg portions are inflated.

In another aspect of the present invention, an article of decorative headwear comprises a decorative primary inflatable portion and a pair of inflatable leg portions. The inflatable leg portions are connected to the primary inflatable portion. Each of the inflatable leg portions extends generally downwardly from a proximal end adjacent the primary inflatable portion to a distal end below the primary inflatable portion. The inflatable leg portions are spaced from one another to define a head-receiving space between them, which is adapted for receiving a portion of a wearer's head. The inflatable leg portions are adapted for engagement with the side surfaces of the wearer's face. The inflatable leg portions have sufficient resiliency, when inflated, to retain the decorative headwear on the wearer's head when the inflatable leg portions are inflated and in engagement with side surfaces of the wearer's face.

In still another aspect of the present invention, an article of decorative headwear comprises at least two flexible sheets of generally gas-impermeable material. The sheets have portions sealed to one another in a manner to define an inflatable volume between the sheets. The sheets are shaped to define an inflatable primary decorative portion and a pair of face-engaging portions extending generally downwardly from the primary decorative portion. The face-engaging portions are monolithic extensions of the sheets. The face-engaging portions are spaced from one another and adapted for engagement with opposite side portions of a wearer's face below the wearer's ears in a manner to retain the headwear on the wearer's head.

A method of the present invention for wearing a decorative article comprises the steps of: providing an article of inflatable headwear comprising a decorative primary inflatable portion and a pair of inflatable leg portions that extend generally downwardly from the primary inflatable portion to define a head-receiving space between them; inflating the article of inflatable headwear; and positioning the article on a wearer's head in a manner so that the inflatable leg portions engage with side surfaces of the wearer's face to retain the headwear on the wearer's head.

While the principal advantages and features of the present invention have been described above, a more complete and thorough understanding and appreciation of the invention may be attained by referring to the drawing figures and description of the preferred embodiments, which follow.

Figure 1:
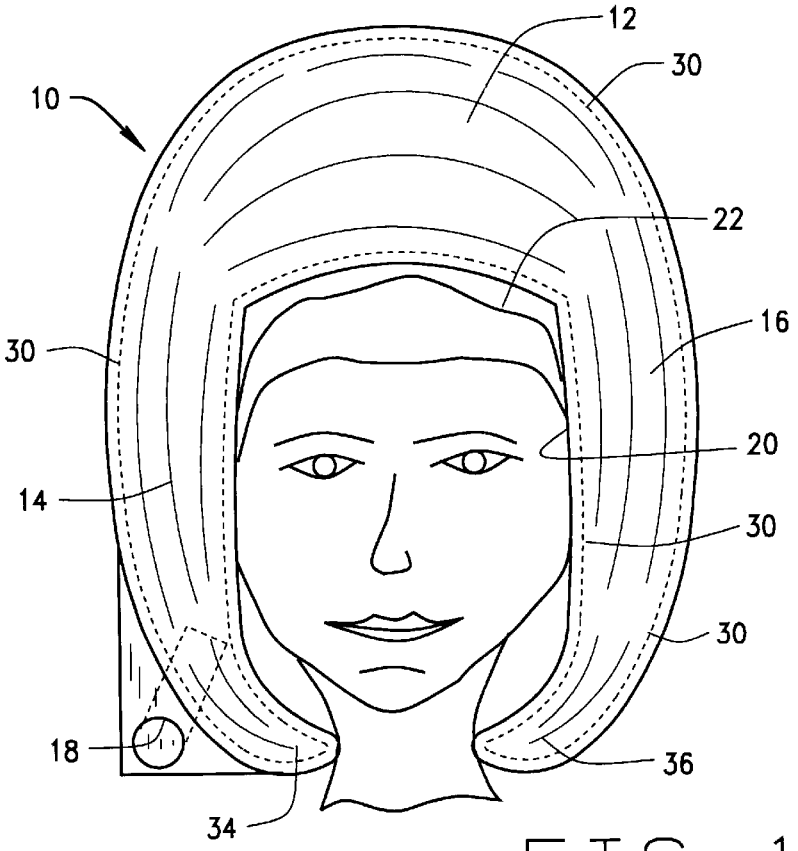
FIG. 1 is a front elevational view of an article of headwear of the present invention, as worn on a wearer's head.

Reference characters in these Figures correspond to reference characters in the following detailed description of the preferred embodiments.

DETAILED DESCRIPTION OF THE PREFERRED EMBODIMENTS

Figure 2:
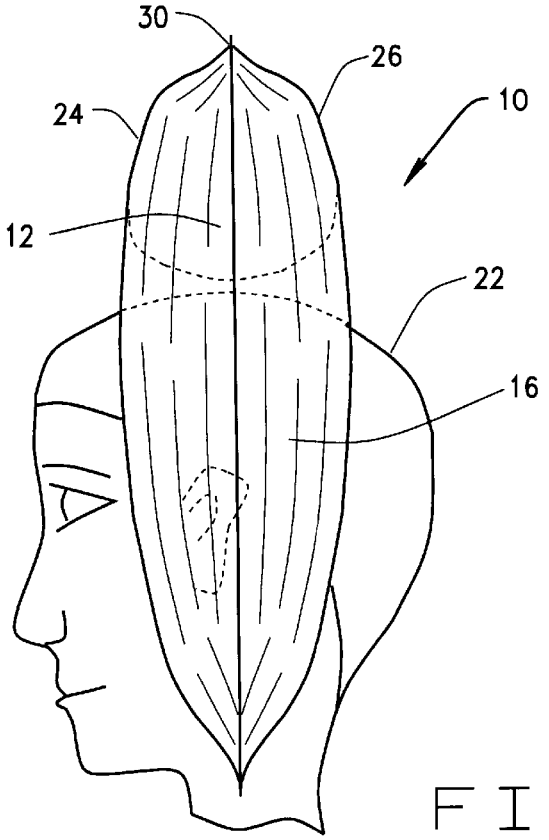
FIG. 2 is a side elevational view of the article of FIG. 1.

An article of headwear of the present invention is represented generally in FIGS. 1 and 2 by the reference numeral 10. The article 10 shown in FIGS. 1 and 2 is somewhat generic in nature, having no particularly ornamental or decorative features, and is intended to help illustrate the structural and functional features of the invention. In general, the article 10 comprises a decorative primary inflatable portion 12, a pair of inflatable leg portions 14 and 16, and an inflation valve 18.

Each of the inflatable leg portions 14 and 16 is connected to the primary inflatable portion 12 and extends generally downwardly from a proximal end adjacent the primary inflatable portion 12 to a distal end below the primary inflatable portion. As shown in FIG. 1, the inflatable leg portions 14 and 16 are spaced from one another to define a head-receiving space 20 between them. The spaced leg portions 14 and 16 together with the primary inflatable portion 12 form a head-receiving space with a generally inverted U-shape. The head-receiving space 20 is adapted for receiving a portion of a wearer's head, which is represented in FIGS. 1 and 2 by the reference number 22. As best shown in FIG. 1, the inflatable leg portions 14 and 16 are adapted for engagement with side surfaces of the wearer's face. As explained below, when inflated, the inflatable leg portions 14 and 16 preferably have sufficient resiliency to retain the decorative headwear 10 on the wearer's head 22 when they are in engagement with the side surfaces of the wearer's face, without the need for a chin-strap or other securing means.

Preferably, the article of headwear 10 comprises a pair of two-dimensional flexible, generally gas-impermeable sheets 24 and 26. In the preferred embodiment, the sheets are of Mylar®, or other suitable flexible and generally gas-impermeable polymeric materials, such as polyesters, polyamides, polyolefins and polyacrylates. Such polymeric sheets may or may not be decorated or "metallized" for aesthetic purposes. Alternatively, the sheets could be of latex or other elastomeric materials.

The use of Mylar® in the manufacture of novelty balloons is well known in the art, and the headwear of the present invention can be constructed using similar known methods. The sheets 24 and 26 have respective peripheral edge portions, which are sealed to one another along a peripheral seal line 30 to define an inflatable volume between the two sheets 24 and 26. Preferably, the two sheets 24 and 26 are generally co-extensive before inflation and the article 10 is rendered three-dimensional when inflated with a fluid, such as helium or air. Thus, the ultimate shape of the inflated, three-dimensional article 10 can be determined by a selected shape of the two-dimensional sheets.

In the preferred embodiment, the primary inflatable portion 12 and inflatable leg portions 14 and 16 are all defined by the same sheets 24 and 26. Also, preferably, the peripheral seal 30 extends around the primary inflatable portion 12 and inflatable leg portions 14 and 16 so that interiors of the primary inflatable portion 12 and the inflatable leg portions 14 and 16 are in fluid communication with one another to define a single inflatable volume.

As best shown in FIG. 1, the inflatable leg portions 14 and 16 include hooked distal end portions 34 and 36, respectively, which extend generally toward one another and into the head-receiving space 20. In the preferred embodiment, the primary inflatable portion 12, inflatable leg portions 14 and 16, and hooked distal end portions 34 and 36 are all defined by the same generally coextensive sheets 24 and 26. Also, preferably, the peripheral seal 30 extends around the peripheries of the primary inflatable portion 12, inflatable leg portions 14 and 16, and hooked distal end portions 34 and 36, so that the interiors of the primary inflatable portion 12, inflatable leg portions 14 and 16, and hooked distal end portions 34 and 36 are all in fluid communication with one another to define a single inflatable volume.

The inflation valve 18 permits inflation of the article. In the preferred embodiment, the valve 18 is of the self-sealing type disclosed in U.S. Pat. No. 4,917,646, which is designed for use in non-latex balloons. In general, the valve is made from two flexible plastic sheets, bonded together to define a valve inlet, a valve outlet and a valve passageway between the inlet and outlet. Preferably, the valve 18 is fitted entirely within the article 10 during manufacture in a manner similar to the way such valves are fitted within non-latex balloons. During manufacture, the valve 18 is secured to an interior surface of one of the sheets 24 and 26 at the periphery thereof so that the inlet and outlet of the valve 18 lie on opposite sides of the seal line 30. The sheets 24 and 26 are then sealed to one another and to the valve 18 along the seal line 30 to integrally fuse the two flexible plastic sheets of valve 18 to the sheets 24 and 26, respectively, of the article 10. As shown in FIG. 1, the valve 18, which may be the heaviest part of the article 10, is preferably located in a lower portion of the article 10 near the distal end of one of the inflatable leg portions 14 and 16.

Of course, other varieties of valves could be used in lieu of the self-sealing type disclosed above. For example, clips or other devices for crimping an inflation port, tightly-tied strings, seals, or other commonly available valves could be used without departing from the scope of the present invention.

When the article 10 is fully inflated (preferably between about 0.50 psi and 1.50 psi), the leg portions 14 and 16 exhibit resilient properties. Because interiors of the leg portions 14 and 16 are preferably in fluid communication with the primary inflatable portion 12, deformation of one or both of the inflated leg portions 14 and 16 that results in a decreased interior volume of the deformed leg portion necessarily results in an increased internal fluid pressure, especially when the sheets 24 and 26 are of substantially non-elastomeric materials such as Mylar®. This increased internal fluid pressure in turn causes a restoring force that tends to bias the deformed inflated leg portion back toward its normal, non-deformed position.

The ideal internal pressure will depend on the dimensions of the article and the materials from which it is fabricated. As discussed below, the article 10 is preferably inflated to an internal pressure sufficient to provide enough resiliency in the leg portions 14 and 16 to retain the article 10 on the wearer's head 22 without the need for a chin-strap or other securing means.

In use, the article 10 is inflated with helium, air or another fluid. Then, the article 10 is positioned on the wearer, with the wearer's head 22 received in the head-receiving space 20 in a manner so that the inflatable leg portions 14 and 16 extend generally downwardly in engagement with side surfaces of the wearer's face. Preferably, the step of positioning the article 10 on the wearer's head includes the step of bending or otherwise moving one or both of the inflated leg portions 14 and 16 generally outwardly to temporarily widen the head-receiving space 20 to facilitate placement of the article 10 over the wearer's head, after which the inflated leg portions 14 and 16 are released and restored to their normal position be the internal fluid pressure. When the wearer's head 22 is received within the head-receiving space 20 and the inflated leg portions 14 and 16 are released and restored to their normal positions, the inflated leg portions 14 and 16 engage against side surfaces of the wearer's face. Preferably, at least part of each inflatable leg portion 14 and 16 engages side surfaces of the wearer's face below the wearer's ears. Although it is possible to position the article 10 on wearer's head 22 before inflating, it is preferable to fully inflate the article 10 before it is positioned on the wearer's head 22, because the resiliency of the inflated leg portions 14 and 16 serves to retain the article 10 on the wearer's head.

Figure 3:
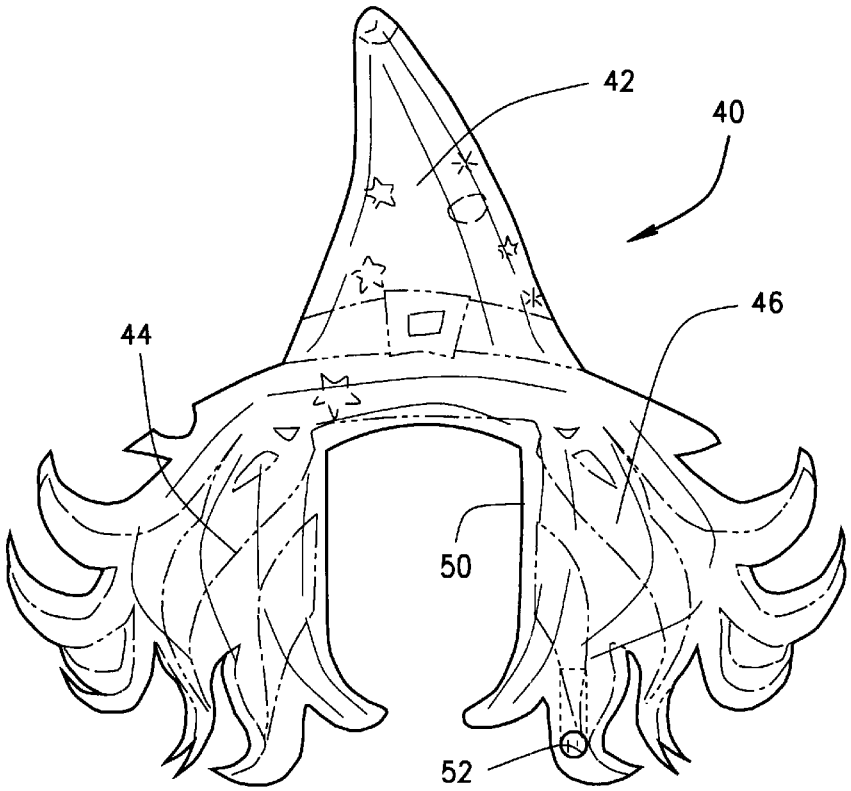
FIG. 3 is a front elevational view of an alternate embodiment of the present invention embracing a Halloween theme.

FIG. 3 is an alternate embodiment of an article of headwear of the present invention embracing a Halloween theme. The article, represented generally by the reference numeral 40, includes a primary inflatable portion 42 and two inflatable leg portions 44 and 46 extending generally downwardly therefrom to define a head-receiving space 50 therebetween. An inflation valve 52 is located near a distal end of the inflatable leg portion 46.

Figure 4:
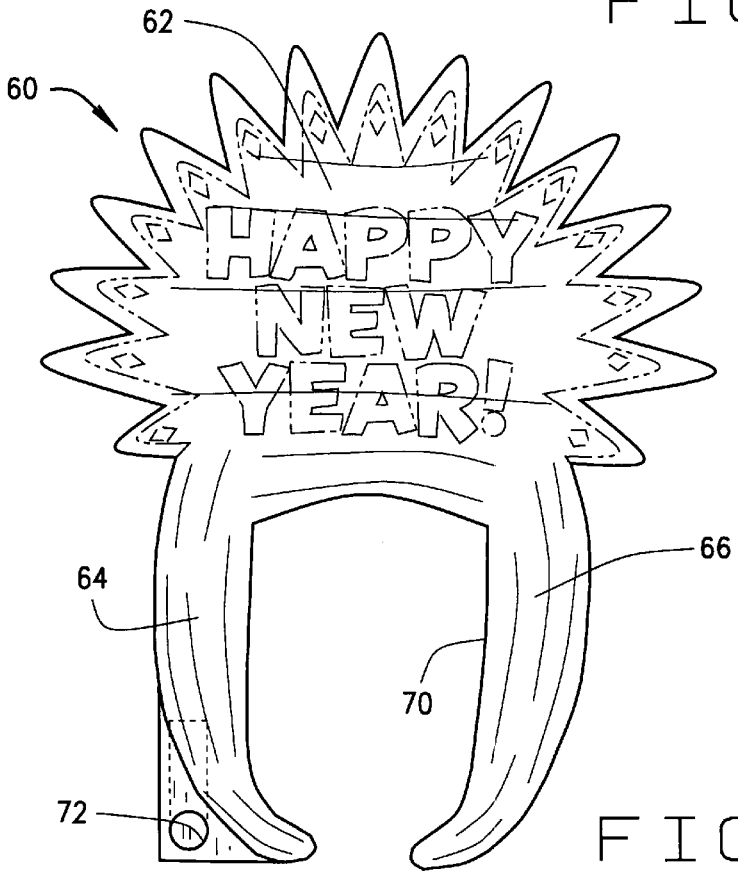
FIG. 4 is a front elevational view of still another embodiment of the present invention embracing a New Year's Day theme.

FIG. 4 is an another alternate embodiment of an article of headwear of the present invention embracing a New Year's Day theme. The article, represented generally by the reference numeral 60, includes a primary inflatable portion 62 and two inflatable leg portions 64 and 66 extending generally downwardly therefrom to define a head-receiving space 70 therebetween. An inflation valve 72 is located near a distal end of the inflatable leg portion 64.

The embodiments shown in FIGS. 3 and 4 are illustrative examples of the myriad of themes and designs for articles of inflatable headwear that can be made in accordance with the present invention. Such articles may be made with a variety of decorative adornments to fit a desired theme.

Thus, the present invention provides a relatively inexpensive means for creating three-dimensional decorative headwear that is designed to be retained on a wearer's head without the need for a chin-strap, even when the headwear is weighted with decorative adornments. Moreover, unlike the prior art, the headwear of the present invention does not cover the wearer's entire scalp. Therefore, the headwear of the present invention would not be uncomfortably warm for prolonged wear and would not undesirably affect the wearer's hair style.

While the present invention has been described by reference to specific embodiments and specific uses, it should be understood that other configurations could be constructed and other uses could be made without departing from the scope of the invention as set forth in the following claims.

What is claimed is:

1. An article of decorative headwear comprising first and second sheets of flexible, generally gas-impermeable material, each of said first and second sheets having a peripheral edge portion, said first and second sheets being sealed to one another at their respective peripheral edge portions to define an inflatable volume between the first and second sheets, said inflatable volume comprising a primary inflatable portion and means for engaging sides of a wearer's face and for securing the headwear to a wearer's head, said primary inflatable portion extending above said face engaging and head securing means in the same generally vertically oriented plane as said face engaging and head securing means when said headwear is worn by the wearer.

2. The article of claim 1 wherein said face engaging and head securing means comprises inflatable leg portions that extend generally vertically downwardly from the primary inflatable portion when the headwear is worn by the wearer, the inflatable leg portions being spaced from one another to define a head-receiving space between them adapted for receiving the wearer's head, the inflatable leg portions being adapted for engagement with side portions of the wearer's face in a manner to retain the headwear on the wearer's head when the inflatable leg portions are inflated, said inflatable leg portions having sufficient resiliency when inflated to retain the headwear on the wearer's head when the inflatable leg portions are inflated and in engagement with the wearer's face.

3. The article of claim 1 wherein interiors of the primary inflatable portion and the inflatable leg portions are in fluid communication with one another to define the inflatable volume.

4. The article of claim 1 wherein the inflatable leg portions include hooked distal end portions that extend generally toward one another.

5. The article of claim 1 further comprising an inflation valve for inflating the inflatable volume.

6. The article of claim 5 wherein the inflation valve is located near a distal end of one of the inflatable leg portions.

7. The article of claim 1 wherein the first and second sheets are of a metallized polymeric material.

8. An article of decorative headwear comprising:

a decorative primary inflatable portion; and means for engaging a wearer's face and for securing the headwear to a wearer's head, the face engaging and head securing means being in fluid communication with the primary inflatable portion and extending downwardly from the primary inflatable portion in the same generally vertically oriented plane as the primary inflatable portion when said decorative headwear is worn by the wearer, the face engaging and head securing means having sufficient resiliency when inflated to retain the decorative headwear on the wearer's head when the primary inflation portion is inflated and the face engaging and head securing means is in engagement with side surfaces of the wearer's face.

9. The article of claim 8 wherein said primary inflatable portion is comprised of a pair of generally coextensive, generally gas-impermeable sheets sealed to one another along peripheral portions thereof to define a primary inflatable volume between said sheets.

10. The article of claim 9 wherein said sheets also define said face engaging and head securing means.

11. The article of claim 9 wherein said sheets are of a metallized polymeric material.

12. The article of claim 8 further comprising at least one inflation valve for inflating the face engaging and head securing and primary inflatable portion.

13. An article of decorative headwear comprising at least two flexible sheets of generally gas-impermeable material, said sheets having portions sealed to one another in a manner to define an inflatable volume between said sheets, said sheets being shaped to define an inflatable primary decorative portion and a pair of face-engaging portions extending generally downwardly from the primary decorative portion when said decorative headwear is worn by the wearer, said face-engaging portions being monolithic extensions of said sheets, said face-engaging portions being spaced from one another and adapted for engagement with opposite side portions of a wearer's face below the wearer's ears in a manner to retain the headwear on the wearer's head.

14. The article of claim 13 wherein said face-engaging portions are also inflatable, and wherein interiors of said face-engaging portions are in fluid communication with said inflatable primary decorative portion to define a single inflatable volume.

15. A method of wearing a decorative article comprising the steps of:

providing an article of inflatable headwear comprising a decorative primary inflatable portion and a pair of inflatable leg portions connected to the primary inflatable portion, wherein said inflatable leg portions extend generally downwardly from the primary inflatable portion to define a head-receiving space between them;

inflating said article of inflatable headwear; and positioning said article of inflatable headwear on a wearer's head in a manner so that the inflatable leg portions extend generally downwardly from the primary inflatable portion and engage with side surfaces of the wearer's face to retain the headwear on the wearer's head.

16. The method of claim 15 wherein the step of inflating said article of inflatable headwear is performed before the step of positioning said article of inflatable headwear on the wearer's head.

17. The method of claim 16 wherein the step of positioning said article includes the step of moving at least one of said inflatable leg portions generally outwardly, thereby widening the head-receiving space to facilitate positioning of the article on the wearer's head.

18. The decorative headwear of claim 1 wherein said face engaging means extends laterally outward from the wearer's face in the same generally vertical plane as the primary inflatable portion when the wearer wears the headwear and comprises a generally planar surface sufficient in area to display indicia thereon.

19. The decorative headwear of claim 8 wherein said face engaging means extends laterally outward from the wearer's face in the same generally vertical plane as the primary inflatable portion when the wearer wears the headwear and comprises a generally planar surface sufficient in area to display indicia thereon.

* * * * *